US006432008B1

(12) United States Patent
Lemmon

(10) Patent No.: US 6,432,008 B1
(45) Date of Patent: Aug. 13, 2002

(54) OCTAHEDRON BALL GAME DEVICE AND METHOD OF USING THE SAME

(75) Inventor: Sean Lemmon, 116 N. Bend Ct., Waco, TX (US) 76710

(73) Assignee: Sean Lemmon, Waco, TX (US)

( * ) Notice: Subject to any disclaimer, the term of this patent is extended or adjusted under 35 U.S.C. 154(b) by 0 days.

(21) Appl. No.: 09/769,782

(22) Filed: Jan. 25, 2001

Related U.S. Application Data

(63) Continuation of application No. 09/277,578, filed on Mar. 29, 1999, now abandoned.

(51) Int. Cl.[7] ..... A63B 37/00; A63B 39/00; A63B 41/00; A63B 43/00; A63B 65/00

(52) U.S. Cl. ..... 473/595; 473/569

(58) Field of Search ..... 473/415, 422, 473/459, 468, 490, 569, 600, 595, 592; 273/146, 353, 244, 244.1, 247, 259, 412, DIG. 8; 446/396, 437; D19/25; D21/373

(56) References Cited

U.S. PATENT DOCUMENTS

D60,575 S * 3/1922 Saart ..... 473/569
4,436,306 A * 3/1984 Sanders ..... 473/569
5,131,665 A * 7/1992 Myers ..... 473/600
5,511,782 A * 4/1996 Maley ..... 473/569

* cited by examiner

*Primary Examiner*—Paul T. Sewell
*Assistant Examiner*—Mitra Aryanpour
(74) *Attorney, Agent, or Firm*—David G. Henry

(57) ABSTRACT

The invention is of a ball game device and method of using the same comprising a octahedron body made of a resilient material preferably durable rubber foam like material, plastic, or rubber and dimensioned to be kicked, rolled, or thrown on a 360 degree, flat, playing surface either indoors or outdoors. The octahedron body has eight equally-sized faces all of which are generally flat-surfaced for resting upon the flat playing surface. Because of the design of the ball game device, it responds to impact in an erratic, unpredictable, flip flopping manner. Each face has indicia displayed thereupon in the form of color, letters, and, or numbers which displays the outcome of each players turn. The face facing upwardly on the surface, after the octahedron body comes to a complete and motionless stop on the surface after being kicked, rolled, or thrown by the user, determines the fate of the user in the ball game.

4 Claims, 7 Drawing Sheets

OCTAHEDRON BALL GAME DEVICE AND METHOD OF USING THE SAME

This is a continuation application with respect to U.S. patent application, Ser. No. 09/277,578, filed on Mar. 29, 1999, now abandoned from which priority is claimed.

BACKGROUND OF THE INVENTION

1. Field of The Invention

The present invention relates to recreational equipment and methods for play of organized games.

2. Background Information

The present invention relates to an octahedron ball game device and method of using the same, for playing a ball game indoors and/or outdoors. It is configured to provide a new form of athletic enjoyment for children and adults of all ages.

This playing ball of the present invention differs from balls of the prior art—the configuration of the former causing it to behave in an erratic, unpredictable, flip flopping manner when it is put into play as hereafter described.

The invention comprises a body member having eight flat, triangular faces formed therein substantially as an octahedron. While the flat, triangular faces are congruent to each other, the dihedral angles formed where the faces meet are not congruent. This is because the cord length from apex to apex to apex, less a desired radius on all edges, or any combination thereof, is not equal. The body member may be hollow or it may be solid, and it may be constructed of materials that vary in their resiliency from substantially firm materials to substantially resilient materials.

Each flat, triangular face may include indicia therein or include some form of color coding. The configuration of the present invention enables it to travel in a rather erratic and unpredictable pattern, unlike the patterns which are attained with a spherical ball. When movement of the ball has come to a completion, the ball will come to rest on one of its eight flat surfaces.

Interesting new games and new competitions can come from new playthings and special balls. The present ball introduces a new challenging, unpredictable game for the enjoyment of the users.

The prior art is known to include that invention entitled PROJECTILE HAVING INDENTED SURFACE AREAS: (U.S. Pat. No. 3,931,971 issued to Bobbie S. Harvey) embodiments of which comprise a body member having a spherical shape with six equally-sized indentations therein with each indentation having an annular rim and having raised indicia on the spherical surface inside the rim and further having a dimple formed on the spherical surface thereof which is used for amusement.

Another prior art invention is that of a BOUNCING CUBE, (U.S. Pat. No. 5,078,408 issued to Jeff D. Myers) which comprises a spherical ball of high density material forming the center of the cube which comprises identical sides and comprises low density material which buckles under impact causing the spherical ball in the cube to react to the impact and respond as a ball.

Also known is the MULTI SURFACE BOUNCING SOLID (U.S. Pat. No. 5,131,665 issued to Jeff D. Myers) which is a nonspherical object, that responds on impact and rebounds a spherical ball, or a size ranging from one to four inches in length and weighing approximately a pound.

Further, BALL GAME DEVICE AND METHOD OF USING THE SAME, (U.S. Pat. No. 5,511,782 issued to Jerry P. Maley) is a ball game device and method of using the same comprising a spherical body made of a resilient material and dimensioned to be kicked or struck on a playing surface either indoors or outdoors. The spherical body has eight equally-sized faces all of which are generally flat-surfaced for resting upon the surface. Each face has indicia displayed there upon which describes and displays an outcome in a baseball game. Base members have words displayed thereon which correspond or are synonyms to the indicia displayed on the spherical body. The face facing upwardly on the surface after the spherical body comes to rest on the surface upon being struck, kicked or rolled by the user determines the fate of the user in the ball game.

Further still, PLAYING BALL (U.S. Pat. No. 4,616,827 issued to James H. Bergland) is a playing ball for kicking, throwing, spinning, rolling, and combinations of these having an outer skin formed by three geometric portions, a central cylindrical disc having a diameter of about nine units of measurement and a pair or flanking dome shaped parabolic portions connected to the cylindrical central portion and both of the domes on the same principal axis as the cylindrical center portion and smoothly connected thereto.

None of these prior known devices or methods of use thereof show or suggest a playing recreational ball device having an octahedron shape with the unpredictable versatility and enjoyment range as in the presently described device.

SUMMARY OF THE INVENTION

It is an object of the present invention to provide a novel ball-like device for recreational use, the configuration of which both causes its erratic progression over a playing surface when propelled during a game, thereby increasing the inherent entertainment through use of the device, but which further, because of multiple indicia on a like number of faces, only one of which comes to rest atop the ball-like device when it comes to rest on a ground surface, affords use in games in which the random occurrence of a particular indicia affects the progression of the game and facilitates more interesting and complicated games than would conventional, spherical game balls.

A further object of the present invention is the provision of a device which consists of eight flat, triangular surfaces and is capable of coming to rest on any one of these triangular surfaces but wherein the statistical odds of the ball coming to rest on any one triangular surface is relatively small.

A further object of the present invention is to provide an amusement device, which produces an unusual pattern of movement whenever it is put into play.

A further object of the present invention is the provision of a device, which can include indicia on a plurality of flat surfaces, the indicia being kept free from interference with the movement of the ball.

A further object of the present invention is the provision of a device which is easy to kick and grip for throwing, but that, because of its configuration, is difficult to kick or throw in a straight line.

A further object of the present invention is the provision of a device, which is economical to manufacture, durable in use, and attractive in appearance.

These and other objects and advantages of the present invention will become apparent to readers from a consideration of the ensuing description and the accompanying drawings. The present invention relates to a ball game device and method of using the same, which comprises an octahedron body preferably made of a resilient material such as a low density, spongy foam-like material, rubber, plastic, or the like and which has eight equally-sized faces. For rendering the ball device suitable for field use as involves kicking, passing, etc., the ball is of a size which approximates that of an American regulation football (never substantially less, but, for certain embodiments, somewhat larger).

The faces of the octahedron body are flat-surfaced and have edges and corners that are rounded to substantially prevent injury to the player/user and also to prevent the edges and corners from tearing. Each face of the octahedron body has indicia thereon, which describes the results of a particular player's turn. The faces are color-coded and can have the symbols 0 ("out"), S (strike), H ("home run"), 1 ("first base"), 2 ("second base"), 3 ("third base"), 4 ("fourth base") displayed on them. The octahedron body is dimensioned and adapted to be kicked, rolled, or thrown in some fashion by a player/user and is allowed to tumble on a flat surface, either indoors or outdoors, such as a playground or gymnasium.

This ball game combines many of the characteristics of baseball, soccer, conventional kickball, and the rolling of dice. The game is played similarly to a conventional kickball game, except the outcome for the offensive player/user in this game is determined by what is displayed on the face of the octahedron body, which is facing upward relative to the surface after the octahedron body stops tumbling. If a particular color is facing upward, on a two color octahedron body, after the octahedron body has stopped tumbling, the offensive player/user would be awarded a specific predetermined result. For example, orange could represent a hit and yellow could represent a strike. If a particular number or letter is facing upward on the octahedron body after the octahedron body has stopped tumbling, the offensive player/user would be awarded the results of that particular number or letter. For example, if the number 2 were facing upward, the offensive player/user would try to make it to second base before a player from the defensive team could get the offensive player/user out. If the letter H was facing upward, the offensive player/user would try to make it to home plate before a player from the defensive team could get the offensive player/user out.

There are two teams that compete against each other. The team with the highest score at the end of the game wins. The field of play is 360 degrees with no out of bounds. There are a total of five bases, which includes home plate, first base, second base, third base, and fourth base. The first, second, third, and fourth bases form a square playing field with home plate directly in the middle of all four bases.

After an offensive player/user has kicked the ball, that offensive player/user will immediately begin to run from home plate to first base, second base and so on until returning to the home plate again and receiving one point. The players in the outfield, or defensive players, are not allowed to touch the octahedron ball until it has come to a complete and motionless stop. Once this has occurred, a player from the defensive team must yell out the symbol or color that is facing upward on the octahedron ball in relation to the surface that the game is being played on. After the defensive player has done this, he/she may/may not elect to pursue the offensive player/user. If the defensive player elects not to pursue the offensive player/user, the defensive player would simply place one of his/her feet on the ball until the offensive player/user has reached the previously announced location. In this case, the offensive player/user would freely advance, without the possibility of being pursued by a defensive player, to the announced location, but must stop once he/she has reached that point. Or, if the defensive player feels that his/her team can get the offensive player/user out, and the defensive player decides to pursue the offensive player/user, the defensive team may attempt to do so by either throwing or kicking the ball at the offensive player/user. If the ball comes in contact with the offensive player/user before he/she reaches the announced location, the offensive team receives an out and the offensive player/user must rejoin his/her team. If the defensive team was unsuccessful in attempting to get the offensive player/user out by kicking or throwing the ball at the offensive player/user, the offensive player/user would not only have made it to the announced location, but would also be allowed to freely advance one additional base. If the announced location had been home plate and the offensive player/user had successfully ran from home plate to $1^{st}$, $2^{nd}$, $3^{rd}$, $4^{th}$, and back to home plate again, with the defensive team unsuccessfully pursuing the offensive player/user, the offensive team would have the option of subtracting one of the offensive teams outs or subtracting one of the defensive teams points. If the result of the play is that the offensive player/user, who's turn it currently is, is supposed to stop at a base but has advanced beyond that base, he/she may freely return without the threat of receiving an out.

DETAILED DESCRIPTION OF THE PREFERRED EMBODIMENT

Figure 1:
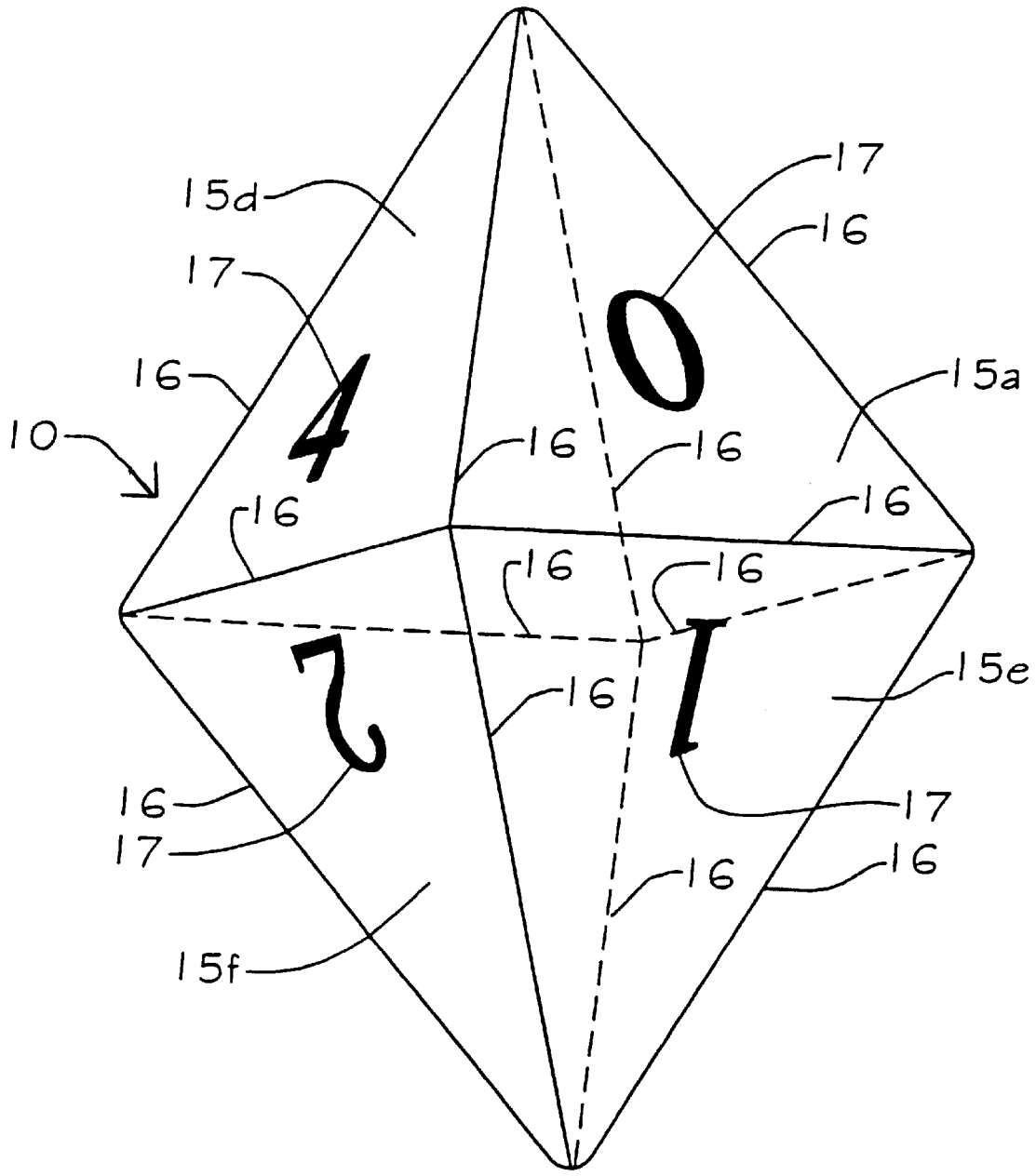
FIG. 1 is a perspective view of the ball game device.
Figure 2:
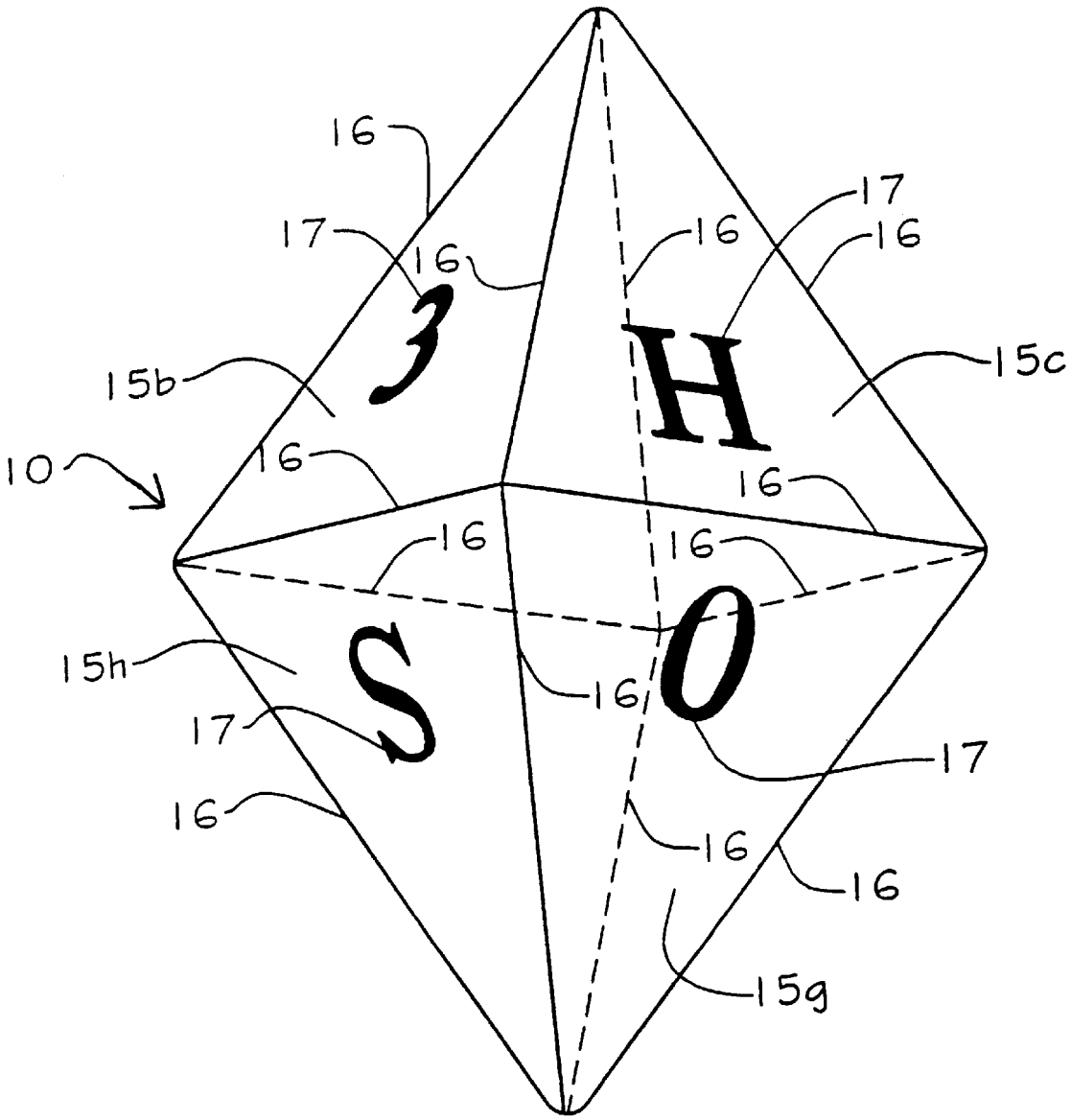
FIG. 2 is a perspective view of the ball game device of FIG. 1, showing different sides.
Figure 3:
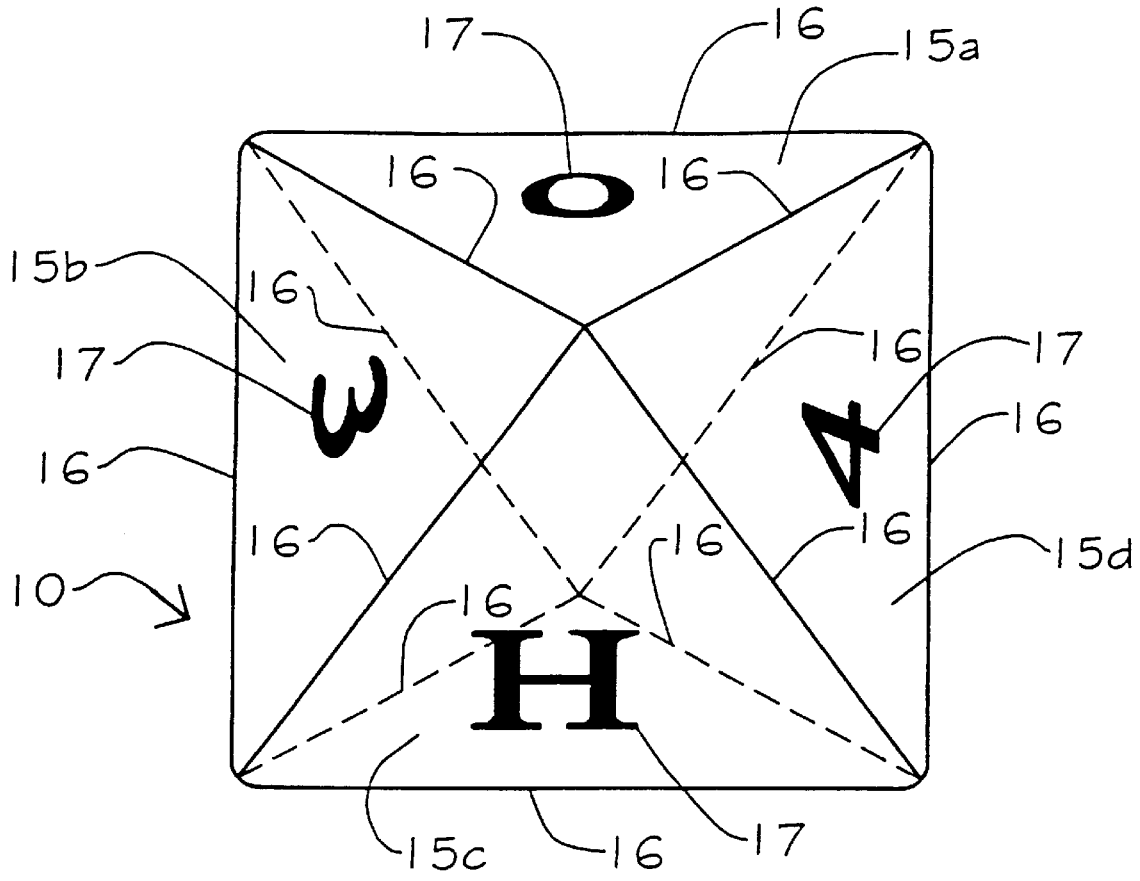
FIG. 3 is a top view of the ball game device of FIGS. 1 and 2.
Figure 4:
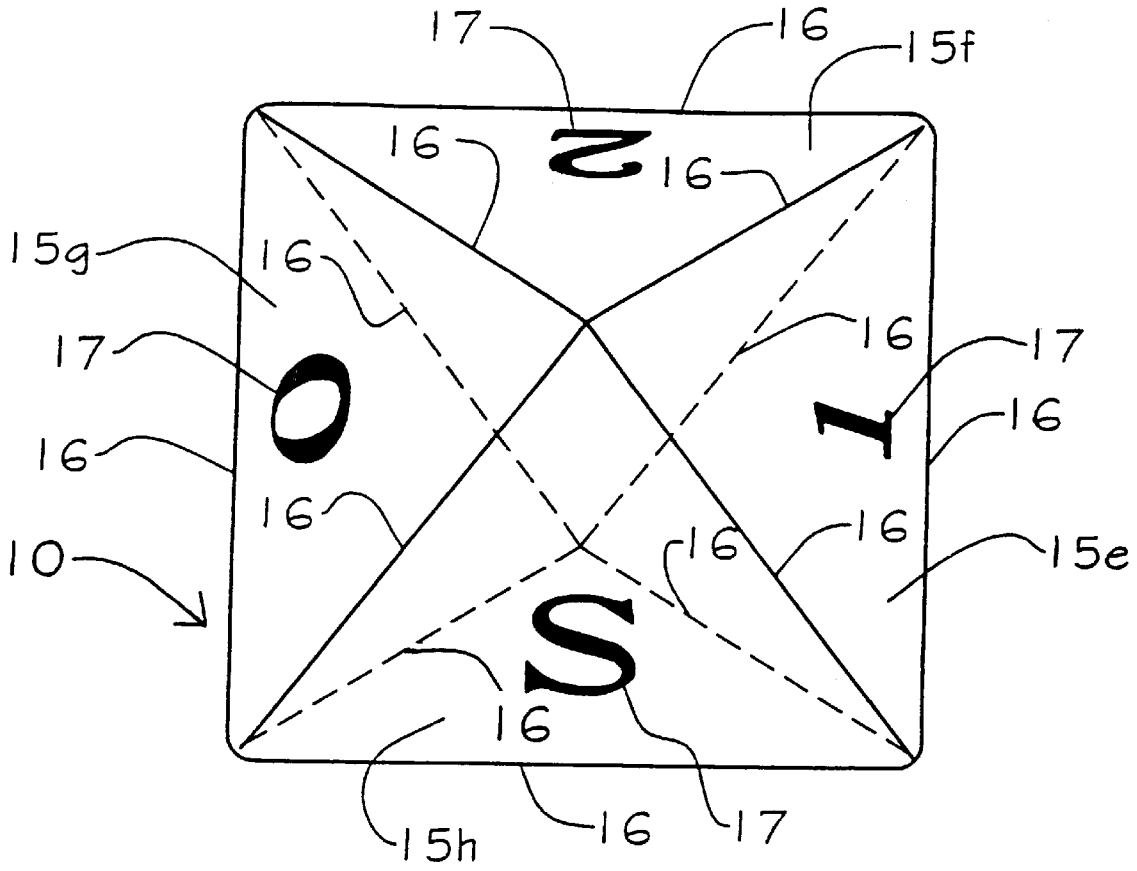
FIG. 4 is a bottom view of the ball game device of FIGS. 1, 2, and 3.

Referring to the drawings in FIGS. 1 through 9, the octahedron ball game device and method of using the same comprises an octahedron body 10 having a dimension such that a user can easily kick, roll, or throw the octahedron body 10 with his/her foot upon a flat surface 50. This means that the body will occupy not less than approximately the space of a regulation American football.

As seen in FIGS. 1–4, the octahedron body 10 has eight equally sized, generally triangular shaped faces 15*a*–*h* which are substantially flat-surfaced and which are evenly spaced about the exterior of the octahedron body 10. The edges 16 are rounded to prevent injury to the user and to reduce the risk of tearing of the octahedron body 10.

Figure 8:
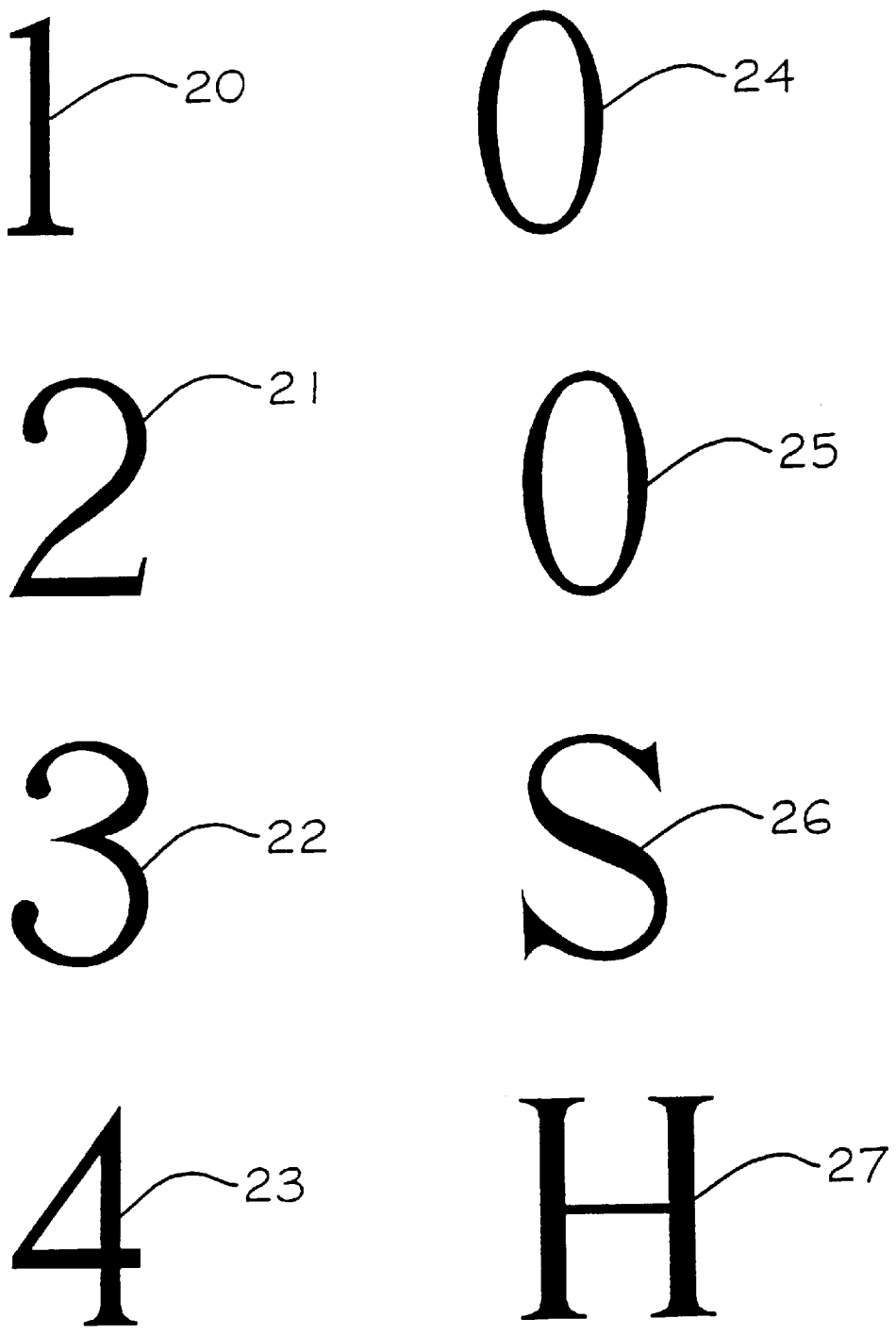
FIG. 8 shows the indicia to be placed on the ball game device as shown in FIGS. 1, 2, 3, and 4.

The faces 15*a–h* each have indicia 17 displayed thereon. which indicia is intended to be used in determining a subsequent event during a game of particular rules which bear on the random occurrence of each of the varying indicia. The indicia 17 can be in a symbol form (letters and numbers, 30–37 as shown in FIG. 8) and/or, in a multi-color form (half of the octahedron body 10 being one color and the other half being a different color, for example). When configured for use in the presently preferred mode, two of the faces 15*a–h* have the symbol "0" 35–36 (or other symbol indicating an "out") displayed thereon, with such two symbols preferably residing on opposite halves of body 10. The octahedron body 10 further, preferably has the symbol "H" 34 (indicating a "home run" according to the preferred mode of use), such indicia being displayed on at least one of the remaining faces 15*a–h*. Further the symbol "S" 37 (indicating a "strike" is displayed on at least one of the faces 15*a–h*. Further still, the symbols "1" (30), "2" (31) and "3" (32), (respectively indicating "first base", "second base" and "third base"are displayed on at least one of the faces 15*a–h*.

Figure 9:
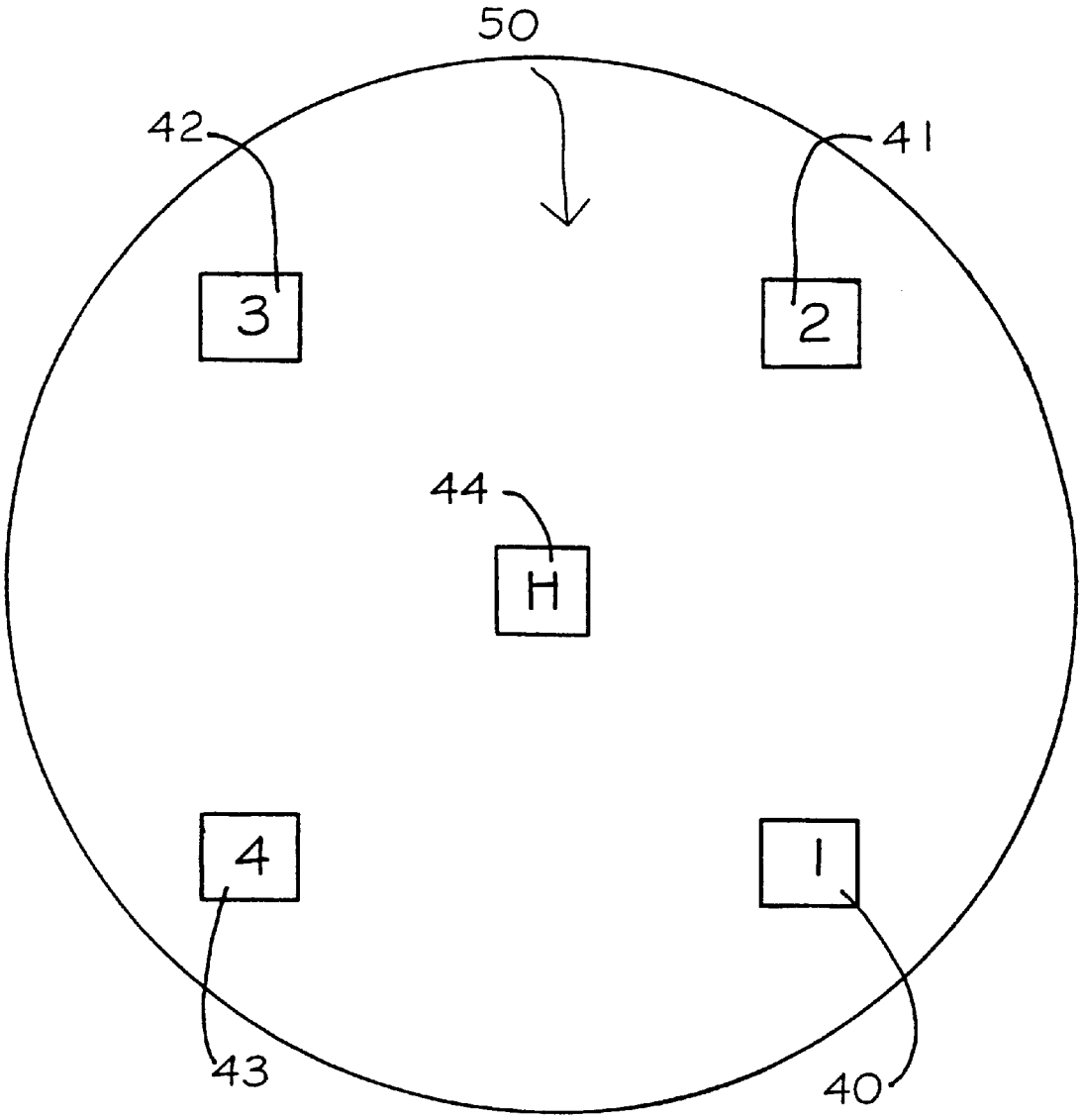
FIG. 9 is a top view of the arrangement of the five bases on a playing surface.

Referring to FIG. 9, the faces 15*a–h* of the octahedron body 10 will rest on any type of flat surface 50, so that upon the user's kicking, throwing, or rolling the octahedron body 10, it will come to rest on one of its faces 15*a–h* with another of its faces 15*a–h* facing upward relative to the surface 50, the face being generally parallel to the surface 50.

Figure 5:
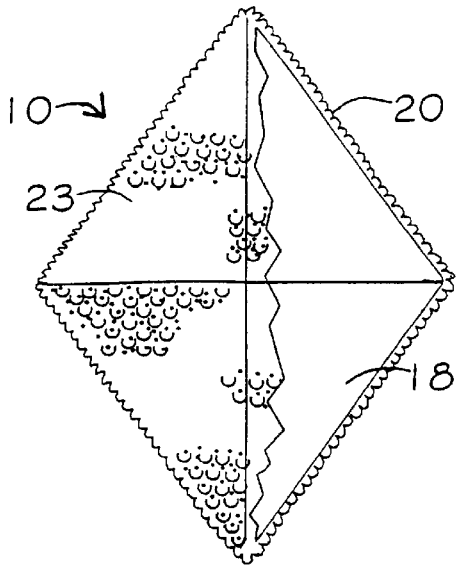
FIG. 5 shows a partially cut away side elevation of the playing ball and indicates a pebbled or grained outer skin configuration on a hollow ball in accord with the present invention.
Figure 6:
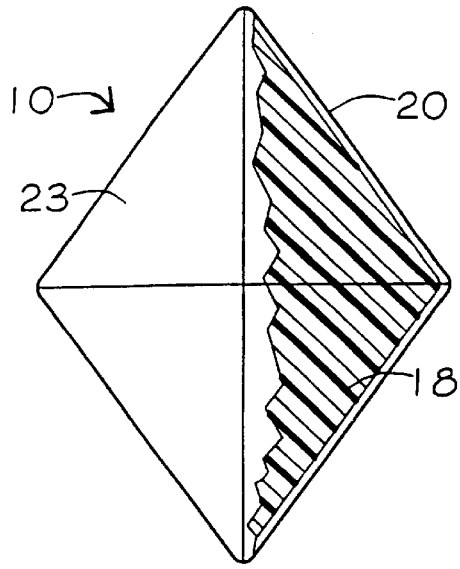
FIG. 6 shows a partially cut away side elevation of the playing ball which is filled with an elastic material imparting bounce, solidity and weight to the playing ball.
Figure 7:
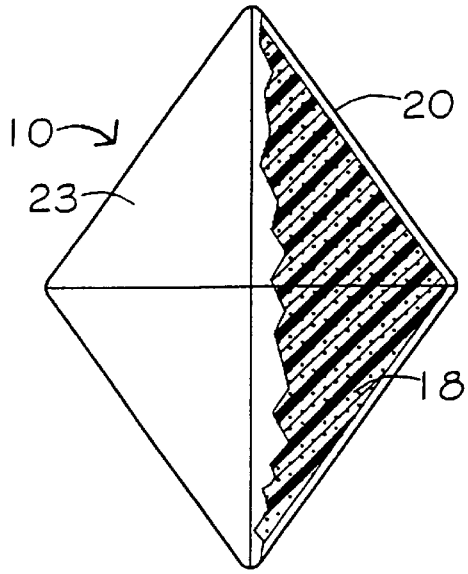
FIG. 7 is a partially exploded side elevation of a playing ball in accord with the present invention and indicating a sponge rubber-like core to provide inherent bounce to the playing ball.

The octahedron body 10 is preferably made of a resilient material such as a low-density, spongy foam-like material, as shown in FIGS. 5–7.

FIG. 5 shows an octahedron body 10 having surface upsets as "pebbling" 23, which texturing provides a friction-generating surface or skin 20. The core 18 is shown empty indicating that the octahedron body 10 of FIG. 5 may be preformed at a given inflating pressure, as a hollow playing ball structure, noninflatable.

In FIG. 6 the octahedron body 10 may comprise an integral or nonintegral skin 20 which is cast or formed from a selectively bouncy or resilient rubber, resin, or plastic material filling the core portion 18, as shown. Any outer ornamentation relief or design can be applied by decorative coatings or molding or combination thereof to the outer surface or skin 23.

The FIG. 7 indicates that the octahedron body 10 may be formed in an integral manner in which the core portion 18 is filled with a sponge-like rubber or foamed urethane and where the forming is against octahedron molds, forming an integral skin 20 with an outer surface 23, as shown. The selection of the core 18 (foam density) can adjust the weight and performance of the octahedron body 10.

The octahedron body 10 is preferably used in a ball game where the offensive user kicks the octahedron body 10. The ball game is played with some of the same characteristics as conventional kickball, baseball, softball, soccer, and dice rolling. The offensive user must reach the base as determined by the outcome displayed faceup on the octahedron body 10 after the octahedron body 10 is allowed to come to rest upon the flat surface 50 of FIG. 9. The outcome displayed on the face 15*a–h* facing upwardly, relative to the flat playing surface 50, after the octahedron body 10 has come to rest on the surface 50, determines whether the offensive user is out, receives a strike, or is given the opportunity to try to advance to first base 40, second base 41, third base 42, fourth base 43, or to home plate 44 of FIG. 9. If the offensive user is to advance to a base 40–44, he/she must do this before a player on the defensive team can get the offensive user out either by kicking or throwing the ball at the offensive user before he/she reaches the base 40–44 that had been identified on the face 15*a–h* of the octahedron body 10 that is facing upward relative to the playing surface 50. If the offensive user comes in contact with the octahedron body 10 at any time during an active play, the offensive team will receive one out and the offensive runner/user must rejoin his/her team. The offensive team is given a predetermined number of outs per offensive time (for example two, three, or four). It takes two strikes in a row, per offensive user, per turn, to receive one out.

As shown in FIG. 9, five base members 40, 41, 42, 43, 44, are to be used and disposed in a spaced relationship to one another on a flat surface 50. First base 40, second base 41, third base 42, and fourth base 43 are to make up the four corners of the square infield, with the home plate 44, being positioned directly in the middle of all four bases 40–43. The ball game is played indoors or outdoors on a flat, 360 degree playing surface 50 convenient for kicking or rolling the octahedron body 10.

This ball game is primarily intended to allow the user, no matter that users age, strength, or abilities, to play with others, no matter their age, strength, or abilities, on an equal basis and to have fun. The offensive user must begin the game by preferably kicking the octahedron body 10 from the home plate 44 position in any direction. The field of play is 360 degrees. There is no out of bounds. The user must then attempt to run to first base 40, then second base 41, and so on. All of the players from the defensive team must now allow the octahedron body 10 to come to a complete and motionless stop, before touching the ball. A defensive player must then determine the outcome of the offensive runner/user kicking, rolling, or throwing the octahedron body 10 by identifying the indicia 17, and yelling out the result of that particular play that would be displayed on the particular face 15*a–h* that is facing upward in relation to the surface 50 that the octahedron body 10 has come to rest on. After doing this, the defensive player would then kick or throw the octahedron body 10 at the offensive player/user in an attempt to touch the offensive player/user anywhere on the offensive player/users body with the octahedron body 10, thereby getting the offensive player/user out.

If a player from the defensive team touches the octahedron body 10 before it has had time to come to a complete and motionless stop, the play is dead and the offensive runner/user would re-kick, re-roll, or re-throw again. If the offensive runner/user comes in contact with the octahedron body 10 at any time during an active play, the play ends, the offensive team receives one out, and the offensive runner/user must rejoin his/her team.

Once a player from the defensive team has had time to allow the octahedron body 10 to come to a complete and motionless stop, determine the outcome of the offensive runner/user kicking, rolling, or throwing the octahedron body 10 by identifying the indicia 17 that is displayed on the particular face 15*a–h* that is facing upward in relation to the surface 50 that the octahedron body 10 has come to rest on, that defensive player must yell out the result, 0 35–36 ("out"), S 37 ("strike"), H 34 ("home run"), 1 30 ("first base"), 2 31 ("second base"), 3 32 ("third base"), 4 33 ("fourth base"). After yelling out the results, that defensive player can place one of his/her feet on the ball. If this is done, the offensive player/user must stop at the location identified by the defensive player 1 30 ("first base"), 2 31 ("second base"), 3 32 ("third base"), 4 33 ("fourth base"), H 34 ("home run"). If the result of the play is a 0 35–36 ("out"), the offensive team would receive one out and the offensive player/user must rejoin his/her team. If the result of the play was a S 37 ("strike") the offensive player/user must return to home plate 44 to rekick, re-roll, or re-throw the octahedron body 10. If the offensive player/user kicks or throws a S 37 ("strike") a second time during his/her same turn, the offensive team would receive one out and the offensive player/user would rejoin his/her team. If the result of the play was an H 34 ("home run"), the offensive player/user must try to run from home plate 44 to first base 40, then second base 41, then third base 42, then fourth base 43, and then back to home plate 44.

If the defensive player that yelled out the results of the play does not place a foot on top of the octahedron body 10, that defensive player along with all the other defensive players can try to get the offensive play/user out by throwing or kicking the octahedron body 10 at the offensive player/user. If the octahedron body 10 comes in contact with the offensive player/user at any time during an active play, the offensive team would receive one out and the offensive player/user must rejoin his/her team. The goal of the offensive player/user is to try to reach the identified base 40–44 before coming in contact with the octahedron body 10.

If an offensive teammate is currently occupying a base 40–43, then that teammate has the option to stay on base 40–43 or leave that base 40–43 and try to make it as far as he/she would like to try and run with the goal of at least making it to the next higher base 41–44 without receiving an out. The offensive player that is currently on base can only exercise these options as long as he/she does not impede the advancement of the offensive player who's turn it is currently. For example, if the offensive player that is currently on base, is located on fourth base 43, and the offensive player who's turn it is currently, kicks a 1 30 (first base ), the offensive player on fourth base 43 does not necessarily have to move. However, if the offensive player that is currently on base, is located on second base 41, and the offensive player who's turn it is has already passed first base 40 and is headed for second base 41 before the ball has come to a complete and motionless stop and the results have been identified, the offensive player located on second base 41, must try to at least advance to the next higher base 41–44, but is not limited to just one base advancement. If the first offensive player wishes to try to advance further, he/she may do so. During the advancement of any and all offensive players, the defensive team can try to get any one of these offensive players out by throwing or kicking the ball at an offensive player and making the octahedron,body 10 come in contact with this offensive players body, as long as the offensive player has moved him/herself off of a base 40–43 in an attempt to make an advancement.

If the result of the play is that the offensive player, who's turn it currently is, is supposed to stop at a particular base 40–43 but has advanced beyond that base 40–43, he/she may freely return to the designated base 40–43 without the threat of receiving an out. If the results of the play is a S 37 ("strike"), or an 0 35–36. ("out"), the play is dead and all offensive players will freely return to where they were prior to the beginning of the last play, without the possibility of receiving an additional out.

In addition to permitting individuals of all different ages, abilities, and strengths to equally compete against each other, this ball game is also intended for the entertainment and exercise of its users.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A method of using a ball device adapted to be used on an athletic field, said ball device having eight triangular sides equally spaced, thereby forming an outer surface, and said eight triangular sides forming an inner cavity, said inner cavity having a soft material filling said inner cavity, said outer surface being made from a different material than said soft material filling said inner cavity, each of said eight triangular sides having indicia thereon, and said athletic field comprising:

a relatively flat playing surface having five bases, four of said five bases arranged around a perimeter and the fifth of said five bases arranged inside said four bases, said method comprising:

dividing players into two teams, offensive players and defensive players, one of said offensive players places said ball device into play by striking said ball device with a portion of the offensive player's body, allowing said ball device to come to a stop on one of said eight sides, a defensive player calls out the indicia on the side of said ball device which is facing upward, said offensive player performs the action indicated by the indicia on the side of said ball device which is facing upward, and stopping all play if said ball device strikes a defensive player before it stops.

2. A method of using a ball device adapted to be used on an athletic field, said ball device having eight triangular sides equally spaced, thereby forming an outer surface, and said eight triangular sides forming an inner cavity, said inner cavity having a soft material filling said inner cavity, said outer surface being made from a different material than said soft material filling said inner cavity, each of said eight triangular sides having indicia thereon, and said athletic field comprising:

a relatively flat playing surface having five bases, four of said five bases arranged around a perimeter and the fifth of said five bases arranged inside said four bases, said method comprising:

dividing players into two teams, offensive players and defensive players, one of said offensive players places said ball device into play by striking said ball device with a portion of the offensive player's body, allowing said ball device to come to a stop on one of said eight sides, a defensive player calls out the indicia on the side of said ball device which is facing upward, said offensive player performs the action indicated by the indicia on the side of said ball device which is facing upward, and awarding an out to said defensive players if said ball device strikes an offensive player before it stops.

3. A method of using a ball device adapted to be used on an athletic field, said ball device having eight triangular sides equally spaced, thereby forming an outer surface, and said eight triangular sides forming an inner cavity, said inner cavity having a soft material filling said inner cavity, said outer surface being made from a different material than said soft material filling said inner cavity, each of said eight triangular sides having indicia thereon, and said athletic field comprising:

a relatively flat playing surface having five bases, four of said five bases arranged around a perimeter and the fifth of said five bases arranged inside said four bases, said method comprising:

dividing players into two teams, offensive players and defensive players, one of said offensive players places said ball device into play by striking said ball device with a portion of the offensive player's body, allowing said ball device to come to a stop on one of said eight sides, a defensive player calls out the indicia on the side of said ball device which is facing upward, said offensive player performs the action indicated by the indicia on the side of said ball device which is facing upward, other offensive players take turns striking said ball device until said defensive players record four outs, and then said defensive players switch places with said offensive players.

4. A method of using a ball device adapted to be used on an athletic field, said ball device having eight triangular sides equally spaced, thereby forming an outer surface, and said eight triangular sides forming an inner cavity, said inner cavity having a soft material filling said inner cavity, said outer surface being made from a different material than said soft material filling said inner cavity, each of said eight triangular sides having indicia thereon, and said athletic field comprising:

a relatively flat playing surface having five bases, four of said five bases arranged around a perimeter and the fifth of said five bases arranged inside said four bases, said method comprising:

dividing players into two teams, offensive players and defensive players, one of said offensive players places said ball device into play by striking said ball device with a portion of the offensive player's body, allowing said ball device to come to a stop on one of said eight sides, a defensive player calls out the indicia on the side of said ball device which is facing upward, said offensive player performs the action indicated by the indicia on the side of said ball device which is facing upward, awarding a point to an offensive player who touches all five bases, and a winner is declared based on the total amount of points scored by each team.

* * * * *